US005951717A

United States Patent [19]

Mrotzeck et al.

[11] Patent Number: 5,951,717

[45] Date of Patent: Sep. 14, 1999

[54] PROCESS AND APPARATUS FOR CONTINUOUS DYEING OF CELLULOSIC CIRCULAR KNITS

[75] Inventors: Uwe Mrotzeck, Kelkheim; Andreas Schrell, Kriftel; Thomas Nauroschat, Frankfurt, all of Germany; Erol Özcan, Istanbul Caddesi, Turkey; Alfred Tressel, Köln, Germany

[73] Assignee: DyStar Textilfarben GmbH & Co., Germany

[21] Appl. No.: 09/037,443

[22] Filed: Mar. 10, 1998

[51] Int. Cl.[6] ..... D06B 3/18; D06B 3/12

[52] U.S. Cl. ..... 8/149.1; 8/639; 8/640; 8/641; 8/642; 8/643; 8/658

[58] Field of Search ..... 8/149.1, 639–643, 8/658

[56] References Cited

U.S. PATENT DOCUMENTS 4,465,490 8/1984 Von Der Eltz ..... 8/40

4,931,064 6/1990 Koch et al. ..... 8/149.1

OTHER PUBLICATIONS

Journal Abstract, Kramrisch, B., "Computer Controlled Garment Steam/Air Finishing System", International Dyer, Textile Printer, Bleacher and Finisher, 179, No. 3: 26–27, Mar. 1994.

*Primary Examiner*—Yogendra Gupta
*Assistant Examiner*—Brian P. Mruk
*Attorney, Agent, or Firm*—Connolly & Hutz

[57] ABSTRACT

A dyeing process comprises continuous dyeing of cellulosic circular knit, which comprises impregnating a rope of said circular knit with an aqueous liquor comprising one or more dissolved and/or dispersed dyes, any necessary fixing alkali and optionally further assistants at a temperature between 20 and 95° C., squeezing off said impregnated rope and subsequently feeding said squeezed-off rope without intermediary drying into an apparatus in which said rope is opened out into a crease-free state and said dye is fixed in an unsaturated steam/air mixture which is at 100 to 160° C. at an autogenous wet temperature of the moist rope of between 50 and 95° C. and a fixing time of at least 20 seconds.

12 Claims, 1 Drawing Sheet

PROCESS AND APPARATUS FOR CONTINUOUS DYEING OF CELLULOSIC CIRCULAR KNITS

DESCRIPTION

Figure 1:
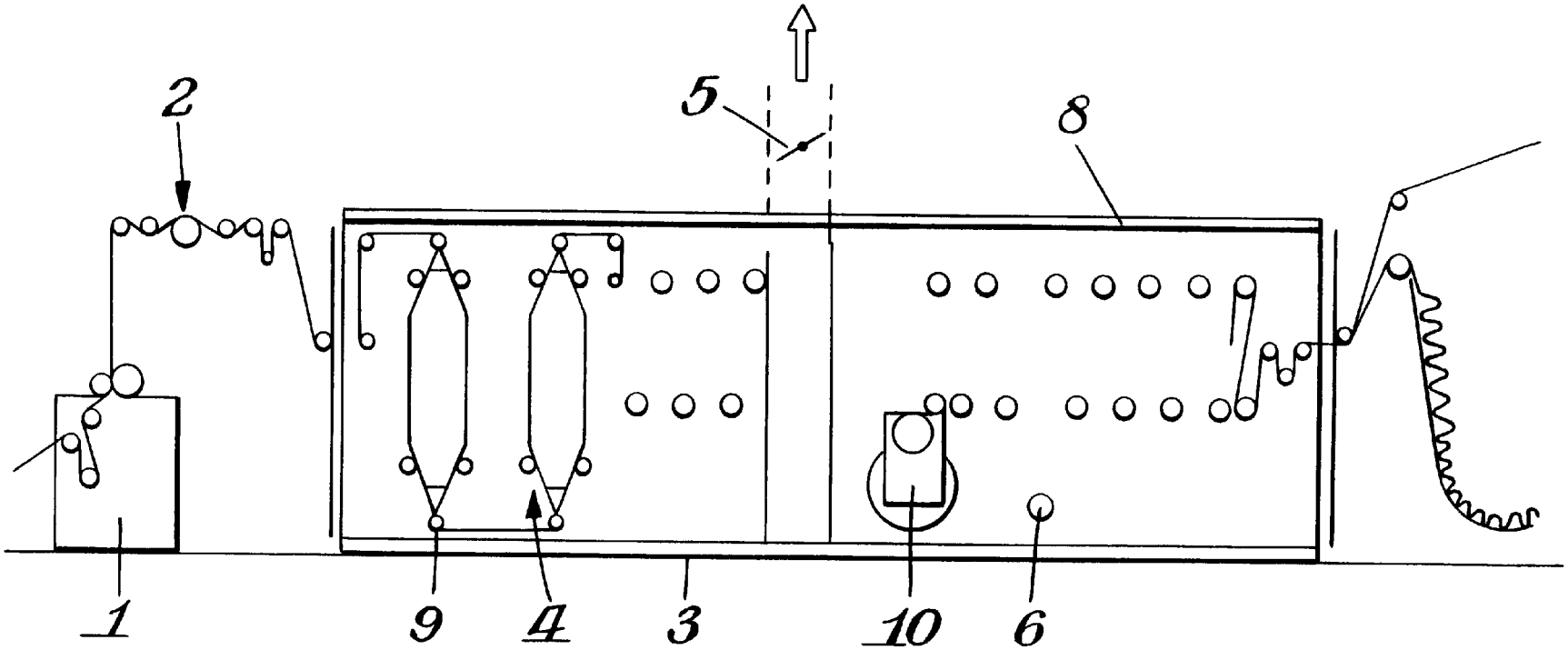

Continuous processes for dyeing flat fabrics with reactive, direct, vat, sulfur or disperse dyes by padding methods are well known and generally provide good results under suitable conditions and a uniform fabric appearance when standardized dyes are used.

The currently most widely used method for dyeing circular knits is the batchwise exhaust method. Semicontinuous and continuous dyeing processes have the advantages of high productivity and high fixing yields over exhaust processes, so that semicontinuous and fully continuous padding processes have is also been developed for dyeing circular knits, for example the semicontinuous cold pad-batch process. Disadvantages of this dyeing process include crease marking due to the plaiting of the impregnated material in boxes, which reduces the quality of the eventual made-up article. In addition, the fixing times are of the order of hours, making efficient dyehouse management very difficult.

Circular knits can also be dyed by fully continuous pad-steam processes. Here the disadvantages are, however, creasing, limited color yield, problems with the appearance of the material and twosidedness of the dyeing. In addition, marks due to liquor running back are observed.

EP-A 1-0 087 740 describes a continuous process for dyeing continuous textile materials—but not textile tubular knits—centered on a fixing unit in which the material is exposed to a steam/air atmosphere having temperatures between 110 and 140° C. for a certain residence time without prior intermediary drying. The moist textile material is at a temperature of 50 to 95° C. and the fixing time is within the range from 20 to 200 seconds.

There are continuous mercerizers for tubular knits which provide optimum handling of the material and ensure an absence of creases. This development is based on tube stabilizers with vertically disposed circular stretchers. These arrangements, also known as "floating cigars" among those skilled in the art, are continuously adjustable in diameter and provide for each material and tube width an individually controlled widthways and lengthways tensioning which is uniformly applied to the entire circumference.

There have also been attempts to achieve continuous dyeing of circular knits by means of two-stage machine designs. The process is described in DE-A-3 619 853 and involves the following principle: After impregnation with a dye solution to a wet pickup of 110 to 120%, the material is introduced into boosters, in which it is once more subjected to the application of a chemical liquor, then inflated and so converted into the crease-free state. For fixing, the material is simultaneously maintained in a saturated steam atmosphere. The advantage of the ballooning in the steamer is not utilized in this process until after the necessary fixing alkali has been applied to the material. This wet-on-wet procedure provides a distinctly lower fixing yield for the reactive dyes than exhaust conditions. Deep shades cannot be achieved. Owing to the high moisture content of the material, the conditions of the inflating and the fixing, this process results in a twosided dyeing and in runback marks. This process has therefore become established only in a few production facilities, for the production of pale shades.

It is an object of the present invention to provide a process for dyeing cellulosic circular knits which avoids the aforementioned disadvantages, predominantly crease and runback marks, and provides good dye fixation coupled with good penetration. It is a further object of the present invention to provide a machine which is suitable for carrying out such a process.

This object is surprisingly achieved by a continuous dyeing process wherein the textile tubular material is treated in a pad-mangle with a dye solution which further comprises any necessary fixing alkali and also optionally further auxiliary chemicals and is subsequently introduced without intermediary drying into an apparatus in which the rope of material is first opened out into a crease-free state and then the moisture content of the material is reduced by thermal means in such a way that no markings due to treatment liquor running back arise even at the first point at which tension or pressure is exerted again on the cloth, for example by a deflecting roll or roller.

The present invention provides in particular a process for continuous dyeing of a cellulosic circular knit, which comprises impregnating a rope of said circular knit with an aqueous liquor comprising one or more dissolved and/or dispersed dyes, any necessary fixing alkali and optionally further assistants at a temperature between 20 and 95° C., squeezing off said impregnated rope and subsequently feeding said squeezed-off rope without intermediary drying into an apparatus in which said rope is opened out into a crease-free state and said dye is fixed in an unsaturated steam/air mixture which is at 100 to 160° C., preferably 110 to 130° C., at an autogenous wet temperature of the moist rope of between 50 and 95° C., preferably 60 to 80° C., and the fixing time is at least 20 seconds.

The dye is fixed at a temperature of the moist cloth, i.e., at a wet temperature, of 50 to 95° C. over a period of at least 20 seconds, generally not more than 300 seconds, preferably 40 to 240 seconds, especially 60 to 180 seconds. The temperature of 50 to 95° C. mentioned for the moist fabric is established by the mixing ratio of steam and air in the steam/air mixture. The temperature of the moist rope of material corresponds to the wet-bulb temperature of the steam/air mixture present. Psychrometers for determining the air content of a steam/air mixture work according to the same principle. The steam/air mixture temperature of 100 to 160° C. is a dry-bulb temperature. In order that the aforementioned wet-bulb, or wet, temperature becomes established on the opened-out tubular rope of material, the moisture content of the steam/air mixture should not exceed 80% by volume. The steam content is advantageously within the range from 10 to 80% by volume, preferably within the range from 10 to 50% by volume, particularly preferably within the range from 15 to 35% by volume. A psychrometer can be used to control the steam injection to establish the desired steam/air ratio.

The measurement of the humidity of air in percent by volume is well known to one skilled in the art and, in addition to the above-described procedure, can also be effected via the determination of the oxygen partial pressures in the fixing chamber relative to those of the external air.

It is advantageous if the process of evaporation reduces the moisture on the opened-out rope of material to such an extent that markings due to treatment liquor running back can no longer arise even at the first point at which the material comes again under tension or pressure. As well as through an appropriate adjustment of the steam/air ratio, the intensity of air circulation or the dry-bulb temperature, this can also be accomplished by means of a longer fixing time.

The fixing time can be lengthened, for example, by reducing the traveling speed of the material and/or by suitable constructional means in the fixing unit, for example by means of a plurality of and/or longer "floating cigars". To obtain optimum dyeing results, the material has to have a post-fixing moisture content of 10 to 25% by weight, preferably within the range from 15 to 20% by weight, on weight of fiber. Conveniently, said rope travels at a speed which is regulated via the measured residual moisture content of said rope on exit from said fixing chamber.

The dyeing process of the invention can be used for treating all customary circular knit articles, such as single jersey, loop plush, interlock, fine rib, piquette and lining or trainer fabrics.

Cellulosic fiber material can consist, for example, exclusively of cellulose fibers, such as cotton, of regenerated cellulose or of cellulose fibers modified with amino-containing compounds, as described for example in U.S. Pat. No. 5,507,840, U.S. Pat. No. 5,565,007, EP-A-0 665 311, U.S. Pat. No. 5,529,586 and DE-A-19 519 023. The cellulosic fiber material can also be blended with synthetic fibers, especially polyester fibers.

The rope of material is impregnated by a one-step padding process, conveniently on a pad-mangle, with an aqueous liquor which includes all the chemicals necessary for the dyeing process to a wet pickup of 80 to 120%, on weight of fiber, and at a temperature of 10 to 95° C., preferably 20 to 40° C.

The dyes used for the process of the invention can be fiber-reactive dyes, acid dyes, direct dyes, sulfur dyes or vat dyes.

The fiber-reactive components of the reactive dyes are selected particularly from sulfatoethylsulfonyl, vinylsulfonyl, chlorotriazinyl, fluorotriazinyl and combinations thereof. Examples of customary reactive dyes are known to one skilled in the art and described for example in EP-A-O 513 656.

Suitable acid or direct dyes include, for example, the diamine dyes ®Sirius Lichtecht dyes, ®Alphanol dyes, ®Cotonerol dyes and ®Duasyn dyes, e.g. C.I. Acid Black 27 (C.I. No. 26 310), C.I. Acid Black 35 (C.I. No. 26 320), C.I. Acid Blue 113 (C.I. No. 26 360), C.I. Direct Orange 49 (C.I. No. 29 050), C.I. Direct Orange 69 (C.I. No. 29 055), C.I. Direct Yellow 34 (C.I. No. 29 060), C.I. Direct Red 79 (C.I. No. 29 065), C.I. Direct Yellow 67 (C.I. No. 29 080), C.I. Direct Brown 126 (C.I. No. 29 085), C.I. Direct Red 84 (C.I. No. 35 760), C.I. Direct Red 80 (C.I. No. 35 780), C.I. Direct Red 194 (C.I. No. 35 785), C.I. Direct Red 81 (C.I. No. 28 160), C.I. Direct Red 32 (C.I. No. 35 790), C.I. Direct Blue 162 (C.I. No. 35 770), C.I. Direct Blue 159 (C.I. No. 35 775), C.I. Direct Black 162:1 and C.I. Direct Violet 9 (C.I. No. 27 885).

The dyes mentioned are present in the aqueous liquor in concentrations of 1 to 120 g/l, based on the total liquor volume, in a dissolved and/or dispersed state. The aqueous solution further comprises the amount of fixing alkali necessary to fix fiber-reactive dyes, advantageously within the range from 0.1 to 4% by weight, based on the weight of the liquor. Suitable fixing alkalis are typically sodium hydroxide, sodium carbonate, sodium silicate, potassium hydroxide, potassium carbonate and sodium bicarbonate. The aqueous liquor may include further assistants, for example electrolyte salts, such as NaCl, KCl, $Na_2SO_4$, $K_2SO_4$, impregnating aids, wetting agents, such as alkanesulfonates, nonionic or anionic surfactants or thickeners, such as polyacrylic acid derivatives or alginates. However, it was found that, surprisingly, the process as of the invention may dispense wholly or partly with otherwise customary electrolyte salts, even if deep shades are to be achieved.

The process of the invention is notable for very good penetration of the materials not only in the case of pale but also in the case of deep shades and produces a product which is free of any crease marks or color runbacks when finished. The surface of the material is free of any mechanical destruction, being completely smooth and free of defects.

The present invention also provides an apparatus for continuous dyeing of a cellulosic circular knit material, consisting essentially of an impregnating apparatus for the textile rope of material to be dyed and a fixing unit consisting of a fixing chamber which includes at least one rope stabilizer and of a measuring and controlling means to set defined relative humidity and temperature conditions in said fixing chamber.

FIG. 1 shows a possible embodiment of such an apparatus.

As shown in FIG. 1, the circular knit is transported into an impregnator (1), for example a pad-mangle trough, and treated therein with the aqueous liquor as described above. The rope of material reemerging from the impregnator has a moisture content of 80 to 120%, based on the weight of the dry material. To adjust the chamber conditions for the process of the invention, the material can be passed through a wetting means (2), where water is sprayed onto it, if necessary, before entering into the fixing chamber (3). Following entry into the fixing chamber (3), the material is opened out into a crease-free state by a tube stabilizer (4). A tube stabilizer ("floating cigar") consists advantageously of a plurality of vertically disposed circular stretchers which are continuously adjustable in diameter and provide for each material and tube width an individually controlled widthways and lengthways tensioning which is uniformly applied to the entire circumference. To lengthen the residence time of the opened tubular material in the fixing chamber (if a longer fixing time is necessary), two or more such tube stabilizers can be arranged in series. At the opposite end of each tube stabilizer, the tube of material is closed again. If, to lengthen the residence time in the fixing chamber, two or more tube stabilizers are arranged in series, the rope of material present between two tube stabilizers should not be subject to any pressure or tension which might lead to marking due to treatment liquor running back. A suitable transportation means is, for example, a deflecting roll or roller having its own drive (9). A suitable measuring and controlling means for setting defined relative humidities and dry-bulb temperatures consists, for example, of a psychrometer (5), a steam injection valve (6) and an air recirculator (10). The actual relative humidity value measured by the psychrometer is converted into a digital signal and compared with the preset target value. Following a computer-aided evaluation of the measurements, a suitable regulating means actuates the air or fresh steam supply in such a way that the chamber atmosphere adjusts to the desired conditions.

On completion of the fixing process, it is advantageous to deflect the dyed material a number of times, for example by a plurality of serially disposed rolls or rollers (8), before it leaves the fixing chamber.

The Examples which follow describe the process of the invention more particularly without restricting it in any way to the features disclosed in the Examples.

EXAMPLE 1

A cotton jersey in tube form, weight about 180 g/m$^2$, is passed through a pad-mangle trough and padded with an aqueous liquor consisting of 50 g/l of the reactive dye C.I. Reactive Red 180 of the formula

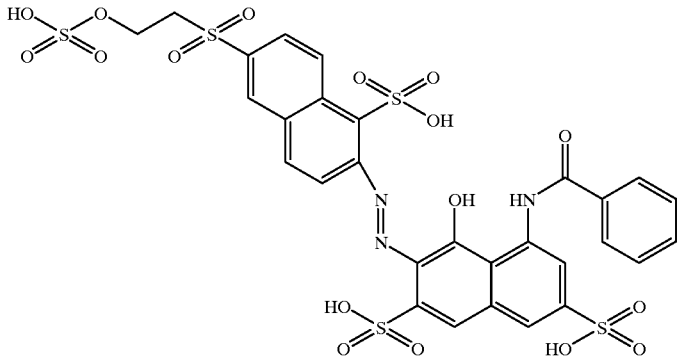

18 ml/l of 32.5% strength by weight aqueous sodium hydroxide solution and 2 g/l of an anionic wetting agent, e.g. ®Leonil SRP, to a wet pickup of 90% at a temperature of about 20° C. The impregnated material is fed at a speed of 20 m/min into an above-described fixing unit and fixed at a wet bulb temperature of 70° C. and a dry bulb temperature of 120° C. for 2.5 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

EXAMPLE 2

A cotton jersey in tube form, weight about 150 g/m$^2$, is passed through a pad-mangle trough and padded with an aqueous liquor consisting of 50 g/l of the reactive dye C.I. Reactive Black 5 of the formula

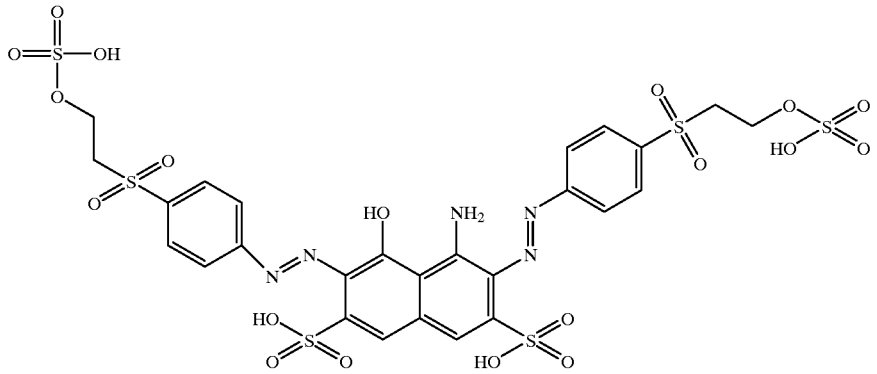

18 ml/l of 32.5% strength by weight aqueous sodium hydroxide solution and 3 g/l of an anionic wetting agent, e.g. Leonil SRP, to a wet pickup of 100% at a temperature of 20° C. The impregnated material is fed at a speed of 20 m/min into an above-described fixing unit and fixed at a wet bulb temperature of 70° C. and a dry bulb temperature of 120° C. for 2 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

EXAMPLE 3

A cotton/linen circular knit material, weight about 220 g/m$^2$ is passed through a pad-mangle trough and padded with an aqueous liquor consisting of 10 g/l of the reactive dye C.I. Reactive Orange 96 of the formula

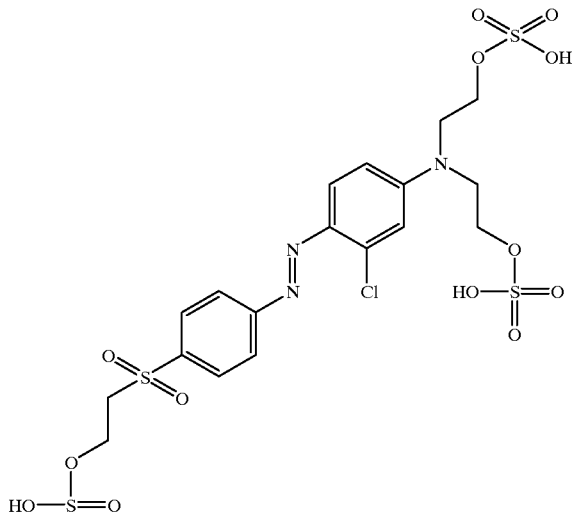

18 ml/l of 32.5% strength by weight aqueous sodium hydroxide solution and 3 g/l of an anionic wetting agent, such as Leonil SRP, to a wet pickup of 90% at a temperature of 20° C. The impregnated material is fed at a speed of 20 m/min into an above-described fixing unit and fixed at a wet bulb temperature of 70° C. and a dry bulb temperature of 120° C. for 3 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

EXAMPLE 4

A cotton/linen circular knit material, weight about 180 g/m$^2$, is passed through a pad-mangle trough and padded with an aqueous liquor consisting of 30 g/l of the reactive dye of the formula

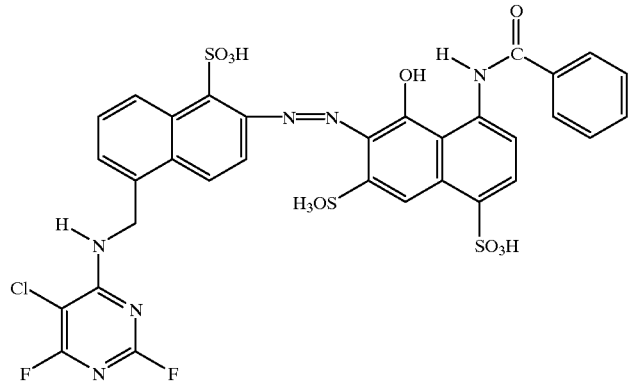

20 g/l of sodium bicarbonate and 3 g/l of an anionic wetting agent to a wet pickup of 80% at a temperature of 20° C. The impregnated material is fed at a speed of 20 m/min into an above-described fixing unit and fixed at a wet bulb temperature of 70° C. and a dry bulb temperature of 120° C. for 2 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

EXAMPLE 5

A cotton terry material in tube form, weight about 230 g/m$^2$, is passed through a pad-mangle trough and padded with an aqueous liquor consisting of 50 g/l of a dye mixture of 10 g/l of C.I. Reactive Orange 107 of the formula

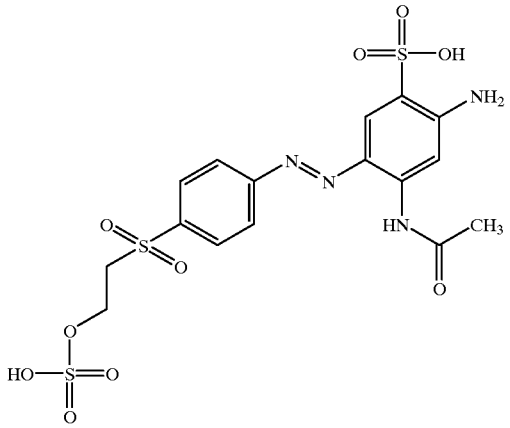

10 g/l of C.I. Reactive Red 180 and 20 g/l of C.I. Reactive Black 5, 18 ml/l of 32.5% strength by weight aqueous sodium hydroxide solution and 2 g/l of an anionic wetting agent to a wet pickup of 90% at a temperature of 20° C. The impregnated material is fed at a speed of 20 m/min into an above-described fixing unit and fixed at a wet bulb temperature of 70° C. and a dry bulb temperature of 120° C. for 2 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

EXAMPLE 6

A cotton lining fabric in tube form, weight about 330 g/m$^2$ is passed through a pad-mangle trough and padded with an aqueous liquor consisting of 50 g/l of a reactive dye of the formula

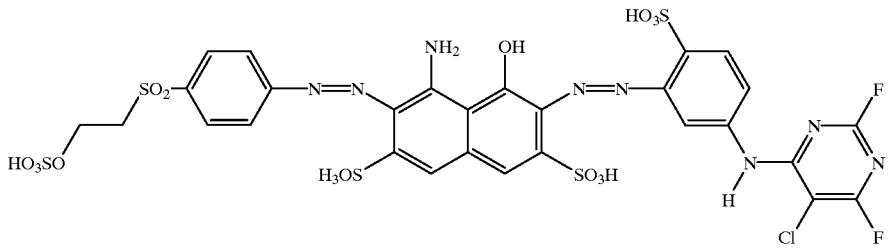

20 g/l of sodium carbonate and 2 g/l of an anionic wetting agent to a wet pickup of 90% at a temperature of 20° C. The impregnated material is fed at a speed of 20 m/min into an above-described fixing unit and fixed at a wet bulb temperature of 70° C. and a dry bulb temperature of 120° C. for 4 minutes. The dyed rope of material then exits the fixing unit with a residual moisture content of about 15%. Thereafter the material can be rolled up or aftertreated in a conventional manner.

The material has a very uniform appearance and a smooth surface and is free of crease marks.

What is claimed is:

1. A process for continuous dyeing of a cellulosic circular knit, which comprises impregnating a rope of said circular knit with an aqueous liquor comprising one or more dissolved and/or dispersed dyes, any necessary fixing alkali and optionally further assistants at a temperature between 20 and 95° C., squeezing off said impregnated rope and subsequently feeding said squeezed-off rope without intermediary drying into an apparatus in which said rope is opened out into a crease-free state and said dye is fixed in an unsaturated steam/air mixture which is at 100 to 160° C. at an autogenous wet temperature of the moist rope of between 50 and 95° C. and the fixing time is at least 20 seconds.

2. The process of claim 1, wherein the unsaturated steam/air mixture has a temperature of 110 to 130° C.

3. The process of claim 1, wherein the autogenous wet temperature of the moist rope is 60 to 80° C.

4. The process of claim 1, wherein the fixing time is 40 to 240 seconds.

5. The process of claim 1, wherein the steam/air mixture has a steam content of 10 to 80% by volume.

6. The process of claim 1, wherein said rope travels at a speed which is regulated via the measured residual moisture content of said rope on exit from said fixing apparatus.

7. The process of claim 1, wherein the post-fixing moisture content is 10 to 25% by weight on weight of fiber.

8. The process of claim 1, wherein said circular knit comprises cotton, regenerated cellulose, cellulose fiber modified with an amino-containing compound or a blend thereof with polyester fiber.

9. The process of claim 1, wherein said impregnating of said rope of material is effected by a one-step padding process.

10. The process of claim 1, wherein said dye is a fiber-reactive dye, an acid dye, a direct dye, a sulfur dye or a vat dye.

11. The process of claim 4 wherein the fixing time is 60 to 180 seconds.

12. The process of claim 5 wherein the steam/air mixture has a stream content of 15 to 35% by volume.

* * * * *

UNITED STATES PATENT AND TRADEMARK OFFICE

CERTIFICATE OF CORRECTION

PATENT NO. : 5,951,717

DATED : September 14, 1999

INVENTOR(S) : Uwe Mrotzeck et al

It is certified that error appears in the above-identified patent and that said Letters Patent is hereby corrected as shown below:

Column 1, line 16, delete "is".

Column 3, line 21, "5,529,586" should read – 5,529,585 –.

Signed and Sealed this

Twenty-fifth Day of April, 2000

*Attest:*

Q. TODD DICKINSON

*Attesting Officer*

*Director of Patents and Trademarks*